US011453234B2

(12) United States Patent
Jolic et al.

(10) Patent No.: US 11,453,234 B2
(45) Date of Patent: Sep. 27, 2022

(54) SECURITY DOCUMENT INCLUDING AN OPTICAL SECURITY FEATURE

(71) Applicant: CCL Secure Pty Ltd, Craigieburn (AU)

(72) Inventors: Karlo Ivan Jolic, Craigieburn (AU); Gary Fairless Power, Craigieburn (AU)

(73) Assignee: CCL SECURE PTY LTD, Craigieburn (AU)

( * ) Notice: Subject to any disclaimer, the term of this patent is extended or adjusted under 35 U.S.C. 154(b) by 0 days.

(21) Appl. No.: 17/151,532

(22) Filed: Jan. 18, 2021

(65) Prior Publication Data

US 2021/0268828 A1 Sep. 2, 2021

Related U.S. Application Data

(63) Continuation of application No. 16/625,089, filed as application No. PCT/AU2018/050671 on Jun. 29, 2018, now abandoned.

(30) Foreign Application Priority Data

Jun. 30, 2017 (AU) ..... 2017902542

(51) Int. Cl.

| | |
|---|---|
| ***B42D 25/351*** | (2014.01) |
| ***B42D 25/41*** | (2014.01) |
| ***B42D 25/29*** | (2014.01) |
| ***B42D 25/355*** | (2014.01) |
| ***B42D 25/378*** | (2014.01) |
| ***B41M 3/14*** | (2006.01) |

(52) U.S. Cl.

CPC ..... *B42D 25/351* (2014.10); *B41M 3/148* (2013.01); *B42D 25/29* (2014.10); *B42D 25/355* (2014.10); *B42D 25/378* (2014.10); *B42D 25/41* (2014.10)

(58) Field of Classification Search

CPC ..... B42D 25/351; B42D 25/41

See application file for complete search history.

(56) References Cited

U.S. PATENT DOCUMENTS

| | | | | |
|---|---|---|---|---|
| 6,867,167 | B1 | 3/2005 | Christen | |
| 8,376,410 | B2 | 2/2013 | Komarek | |
| 2005/0230959 | A1 | 10/2005 | Nemeth | |
| 2007/0085337 | A1 | 4/2007 | Endres | |
| 2008/0191462 | A1 | 8/2008 | Derfler | |
| 2008/0250954 | A1 | 10/2008 | Depta | |
| 2011/0239885 | A1 | 10/2011 | Marchant et al. | |
| 2012/0187673 | A1* | 7/2012 | Stewart | B42D 25/29 283/72 |
| 2014/0227487 | A1 | 8/2014 | Warwick | |
| 2014/0306441 | A1* | 10/2014 | Lister | B42D 25/41 283/85 |
| 2014/0312606 | A1 | 10/2014 | Lister | |

OTHER PUBLICATIONS

International Search Report for PCT/AU2018/050671 dated Sep. 14, 2018.

* cited by examiner

*Primary Examiner* — Kyle R Grabowski

(74) *Attorney, Agent, or Firm* — Christopher M. Scherer; DeWitt LLP

(57) ABSTRACT

A security document, including: a polymer substrate; at least one print layer disposed on one or both sides of the polymer substrate; and a security feature including an image area embodied within the polymer substrate and at least partially covered by the at least one print layer, wherein the security feature is an optical security feature formed in the image area.

11 Claims, 4 Drawing Sheets

SECURITY DOCUMENT INCLUDING AN OPTICAL SECURITY FEATURE

CROSS-REFERENCE TO RELATED APPLICATIONS

The present application is a continuation of U.S. application Ser. No. 16/625,089, filed Dec. 20, 2019, which application is the U.S. national stage application of International Application No. PCT/AU2018/050671, filed Jun. 29, 2018, which international application was published on Jan. 3, 2019 as International Publication No. WO2019/000049. The International Application claims priority to Australian Patent Application No. 2017902542, filed Jun. 30, 2017, the contents of which are incorporated herein by reference in their entireties.

TECHNICAL FIELD

The invention relates generally to security documents in which security features are used as an anti-counterfeiting measure, and in particular to the configuration of optical security features.

BACKGROUND OF INVENTION

Security features are applied to security documents or similar articles, such as identity cards, passports, credit cards, bank notes, cheques and the like and may take the form of diffraction gratings and similar optically detectable microstructures. Such security features are difficult to falsify or modify, and are easily damaged or destroyed by any attempts to tamper with the document. Often security features are designed to be overt features of the document, such that they are observable with the naked eye. This type of public or primary security feature enables members of the public to perform some degree of authentication of the document, without the use of any additional viewing apparatus.

The ever increasing sophistication of counterfeiting operations requires continuous improvement in the design of security features for protecting documents against forgery. Whilst it is difficult for a counterfeiter to reproduce the exact optical effect of security features such as the overt features described, forgeries that produce an optical effect sufficiently similar to deceive a casual observer are readily produced. Moreover, members of the public are typically not skilled in detecting the minor variations produced by the counterfeit optical effects.

An optical security feature incorporated into some existing polymer based banknotes includes an image embodied within an opacifying layer of a polymer substrate of a polymer based banknote which is more visible in transmission than in reflection. An image embodied within the opacifying layer is generally known as a shadow image.

One existing method of producing a shadow image includes applying ink to a polymer substrate, typically in a number of layers, so that at least one ink layer on the substrate is varied in thickness. The subtle variance in thickness contributes to additional light being absorbed when the shadow image is viewed in transmission. Thus, for instance, despite the ink being used in this existing method being white, the extra amount of white ink absorbs slightly more transmitted light and as such appears darker in transmission. In reflection, this is less so as the entire surface reflection is white and the layers below the surface contribute only to a small increase in additional reflection.

An alternative existing method of producing a shadow image includes adding an extra print layer of white to the multiple print structures in the form of the shadow image on the polymer substrate. The effect is similar to the above existing method as the extra layer of white becomes an additional absorbing layer when viewed in transmission.

Further, with shadow images produced by these two existing methods, assuming that there is negligible absorption of light by the polymer substrate, it will be appreciated by those persons skilled in the art that the maximum transmissive contrast of the shadow image is dependent on the largest total opacified thickness and the smallest total opacified thickness within the shadow image area. For example, the darkest parts of a shadow image viewed in transmission are formed using four opacified layers (two on the front of a banknote and two on the back) and the brightest parts of the shadow image viewed in transmission are formed using three opacified layers (two on the front of the banknote and one on the back). To illustrate the principle, for simplicity, the maximum transmission contrast ratio may be defined as the largest total opacified thickness divided by the smallest total opacified thickness within the shadow image area. In this example, this equals 4/3=1.33. In a second example, the darkest parts of the shadow image viewed in transmission are formed using five opacified layers (three on the front of the banknote and two on the back) and the brightest parts of the shadow image viewed in transmission are formed using four opacified layers (two on the front of the banknote and two on the back). In the second example, the transmission contrast ratio as defined above equals 5/4=1.25. Thus, the contrast in the second example is lower than the first example.

It will be appreciated by those persons skilled in the art that the transmission contrast can be increased by increasing the total opacified thickness. This can be achieved by applying multiple layers of opacification (from, say, multiple print units), in register, to form a shadow image. Each of the opacification layers, however, has a registration error which limits the complexity of the shadow image that can be formed with the multiple opacification layers. That is, as the shadow image complexity increases, fewer opacification layers can be used due to the registration error, which reduces the transmission contrast.

Also, the perceived maximum transmission contrast depends not only on the number of opacified layers, but also on the complexity of the design of the shadow image. Simpler designs will appear to have more contrast than complex designs implemented with the same maximum and minimum opacifying layer thicknesses. Furthermore, the recognisability of the shadow image, and its printed resolution, may also impact on the perceived contrast. For simple designs, if multiple opacification layers are used to form the shadow image, the registration error does not have a deleterious effect on the appearance of the shadow image; this is because the design elements forming the shadow image are so large that the registration error cannot be noticed by the viewer. For simpler designs, this means a larger number of opacifying layers can be applied, which in turn means a larger transmission contrast can be achieved. However, in the case of higher complexity shadow images, fewer opacifying layers can be applied, otherwise the misregister of the multiple layers will have a deleterious effect on the appearance of the shadow image. The shadow image will appear blurred due to the registration error. The maximum transmission contrast achievable in high complexity shadow images is therefore less compared to what can be achieved with low complexity shadow images.

The amount of ink which can be effectively printed in a single image and hence its contrast ratio is related to the fidelity of the image produced and proportionally related to the degree of visibility in reflection. That is, as more ink is applied to increase the contrast, and the maximum opacifying thickness is increased, the degree of visibility in reflection is also increased which is undesirable in a shadow image. Thus, increasing the contrast in transmission comes at the expense of also increasing it in reflection which is undesirable as shadow images are most effective as a security feature when they are covert or hidden in reflection and strongly visible in transmission.

Moreover, if a person were determined to counterfeit a bank note with shadow images produced according to the above existing methods, it could be possible to take a genuine polymer banknote of a low value and wash off all of the ink, and replace the shadow image with an alternative shadow image from a higher value polymer note. Also, the existing shadow images may be able to be counterfeited as they are made by spatially varying (e.g. reducing) the number of opacifying overcoats applied to the polymer film which can be replicated. They also have relatively low durability as the shadow images formed from the opacifying overcoats can easily wear off or be rubbed off.

SUMMARY OF INVENTION

Accordingly, one aspect of the present invention provides a security document, including: a polymer substrate; at least one print layer disposed on one or both sides of the polymer substrate; and a security feature including an image area embodied within the polymer substrate and at least partially covered by the at least one print layer, wherein the security feature is an optical security feature formed in the image area.

In some embodiments, the optical security feature is discernible when illuminated by light and when viewed in transmission of said light though the security feature.

In an embodiment, the polymer substrate is at least partially transparent to transmitted light. The polymer substrate may include a transparent substrate of the security document or a clear coating applied to the transparent substrate. For example, the security document is a bank note and the transparent substrate is a polymer based substrate. In addition, the light is preferably white light.

In another embodiment, the polymer substrate is opaque to transmitted light. The polymer substrate may include an opaque substrate of the security document. For example, the security document is a bank note and the opaque substrate is a white polymer based substrate.

In an embodiment, the print layer is an opacifying layer, being a layer applied with a primary function to increase the opacity of the polymer substrate on which it is applied. Alternatively, the print layer is a design layer, being a layer applied with a primary function related to embodying a design on the polymer substrate. The opacifying layer is typically a light colour of ink, such as white layer of ink, or a light yellow, light green, light blue etc. The design layer is typically a different colour of ink to the opacifying layer colours, and typically includes indicia or designs in these different colours. In both embodiments, the print layer is substantially opaque when viewed in reflection so as to hide the optical security feature formed in the image area. Examples of print layers include a white layer (e.g. opacifying layer) and an indicia layer (e.g. non opacifying layer including a design having a different colour).

Where the polymer substrate is translucent or at least partially transparent to transmitted light the print layer may also be translucent or at least partially transparent to transmitted light. Thus, when the at least one print layer at least partially covers the image area, a high contrast optical security feature is created when viewed in transmission which is not discernible when viewed in reflection. It will be appreciated by those persons skilled in the art such an optical security feature may be referred to in the art as a shadow image.

Where the polymer substrate is opaque, the print layer may also be opaque. The print layer may include a printed image overlying at least part of the optical security feature. The printed image may thus camouflage the optical security feature, which may otherwise be visible when viewed in reflection.

In an embodiment the optical security feature is derived from the printed image such that the printed image wholly overlies the optical security feature. For example, where the security document is a banknote, the optical security feature may be derived from a banknote design element. Such a banknote design element may be a portrait design element, for example an intaglio-printed portrait typically found on a banknote, or it may be another imagery design element printed on the banknote, for example an imagery element printed in the gravure process. The printed image may be dark in colour to assist in camouflaging the optical security feature.

The optical security feature may be a threshold image of the banknote design element or any image derived by image processing or manipulating the banknote design element. Preferably, the design of the optical security feature allows for a registration tolerance between the optical security feature and printed image.

For example, the optical security feature could be an image which represents a portion of the grey levels found in the banknote design element, for example a dithered binary image that represents the lighter grey levels or the darker grey levels of the banknote design element. The optical security feature would thus be disguised by the banknote design element when viewed in direct reflection. In this embodiment, the optical security feature may not be clearly visible when viewed in transmission, although there may be a contrast between the optical security feature and the printed image due to light being absorbed by the optical security feature. However this embodiment may produce an indelible image in the polymer substrate, which still exists after the print layer wears off in circulation, thus providing a security feature to the banknote.

In another embodiment, the optical security feature may differ from the printed image such that the printed image does not wholly overlie the optical security feature. For example, the optical security feature may be a design element or pattern that differs substantially from the printed image. The optical security feature may be a recognisable design element, such as a faint portrait image, that is overprinted with a repeating pattern of lines and/or dots, which effectively camouflages the optical security feature, thus making it invisible when viewed in direct reflection, yet visible when viewed in transmission. The end result may be considered as a type of shadow image.

In an embodiment, the image area is completely covered by the at least one print layer disposed on one or both sides of the polymer substrate. The optical security feature can thus be more covert in reflection, which increases its effectiveness as a security feature.

In an embodiment, the polymer substrate has particles disposed therein configured to react to a designated wavelength of light from a light source to mark or opacify the polymer substrate adjacent the particles to form the optical security feature. For example, the particles are provided by a pigment embodied in the transparent substrate or the clear coating.

In an embodiment, the particles react to the designated wavelength of light by absorbing energy from the designated wavelength of light and vaporising the polymer substrate adjacent the particles to form bubbles or markings in the polymer substrate.

In a transparent substrate, these bubbles scatter light to create a white appearance of the optical security feature when the optical security feature is viewed in direct reflection of light from the security feature. That is, these bubbles scatter light and would create a white appearance of the optical security feature if it was viewed directly without the print layer at least partially covering it.

In an opaque substrate, the markings absorb light to create a dark appearance of the optical security feature when the optical security feature is viewed in direct reflection of light from the security feature. That is, the markings absorb light and would create a dark appearance of the optical security feature if it was viewed directly without the print layer at least partially covering it.

In both the transparent and opaque substrate, these bubbles (or markings) also scatter (or absorb) light to create a dark appearance of the optical security feature when the optical security feature is viewed in transmission of the light through the security feature.

In the embodiment of a transparent substrate, when the optical security feature is covered by a print layer, the optical security feature is not readily discernible in reflection, which increases its effectiveness as a security feature. For example, in the embodiment where the print layer is an opacifying layer in the form of a white layer, the optical security feature is not discernible in reflection due to the white appearance of the optical security feature beneath the opacifying layer.

That is, in the embodiment, the bubbles appear white when they are viewed directly in the polymer substrate, via reflected white light, when a print layer is not covering the bubbles between the bubbles and the naked eye. When a print layer is applied over the bubbles, between the viewer's naked eye and the bubbles, the optical security feature is hidden from view in reflection as the bubbles are occluded from the naked eye by the print layer. As mentioned, in banknotes, the print layer, such as an opacifying layer, is typically a light colour, such as white, light yellow, light green, light blue etc., depending on the design colour of the bank note that is chosen.

The bubbles appear dark when they are viewed directly in the polymer substrate, via white light transmitted through the polymer substrate, when a print layer is not covering the bubbles between the bubbles and the naked eye. The bubbles appear dark because they scatter transmitted light away from the naked eye and or partially absorb it—that is, the optical security feature reduces the amount of transmitted light reaching the naked eye. After a print layer is applied over the top of the bubbles—on one or both sides of the polymer substrate—the optical security feature still appears dark when viewed in transmission, as the print layer is translucent or partially transparent to transmitted light.

In the embodiment of an opaque substrate, when the optical security feature is covered by a print layer, the optical security feature may be camouflaged or disguised in reflection. For example, where the print layer includes a dark printed image wholly or partially overlying the optical security feature, the optical security feature may not be readily discernible in reflection. The markings, however, may be discernible in transmission, particularly where the printed image does not wholly overlie the optical security feature.

In an alternative embodiment, the polymer substrate has particles disposed therein configured to react to a designated wavelength of light from a light source to delete or bleach the polymer substrate adjacent the particles to form the optical security feature. For example, the polymer substrate is a Diazo layer which is produced using light and then fixed using heat and then covered by the at least one print layer.

Another aspect of the present invention provides a method of manufacturing a security feature for a security document, the method including: irradiating an image area embodied within a polymer substrate of a security document with a designated wavelength of light produced from a light source; the polymer substrate having particles disposed therein reacting to the designated wavelength of light to mark the polymer substrate adjacent the particles to form an optical security feature in the image area; and at least partially covering the image area with at least one print layer disposed on one or both sides of the polymer substrate, thereby forming the security feature as the optical security feature in the image area.

In some embodiments, the optical security feature is discernible when illuminated by light and when viewed in transmission of the light though the security feature.

A security feature manufactured according to the method overcomes the above contrast issues associated with prior art shadow images by irradiating particles embodied in, for instance, pigment in the polymer substrate to form the optical security feature. One such pigment is LS800, which is described in U.S. Pat. No. 6,545,065.

As mentioned, the particles react to a designated wavelength of light from a light source to opacify the polymer substrate to form the optical security feature. In this embodiment, the light source is a laser and the choice of laser depends upon the absorbing moiety within the polymer substrate. For example, if the pigment is LS800 then the laser is a CO2 laser. The pigment interacts with the laser energy to vaporise the materials around it to create the small bubbles within the polymer substrate which act to scatter light.

In an embodiment, the method further includes irradiating an image mask provided between the light source and the polymer substrate of the security document with the designated wavelength of light produced from the light source. In the embodiment, the image mask includes an image area corresponding to the optical security feature formed from a first material and a complementary area to the image area formed from a second material. The first material is transmissive to the designated wavelength of light produced from the light source and the second material is not transmissive to the designated wavelength of light. For example, the first material is a transparent material and the second material absorbs and dissipates energy generated by the light source at the designated wavelength of light so that the laser energy transmitted through the image mask is in the form of the optical security feature.

Embodiments of this method of manufacturing a security feature can therefore provide an optical security feature in a security document that is more covert in reflection which increases its effectiveness as a security feature. The embodiments also provide an optical security feature that has greater durability as they are formed within the polymer substrate.

As mentioned, the optical security feature is formed by creating bubbles (or markings) embodied within the polymer substrate, which scatter (or absorb) light to create a white (or dark) appearance of the optical security feature when the security document is viewed in reflection and a dark appearance when viewed in transmission. As such, the optical security feature formed according to the method is indelible and more copy resistant.

Indeed, when compared with the above mentioned prior art shadow image or watermark type security features in polymer security documents, the security feature formed according to one or more of the above embodiments has at least the following advantages. The security feature is more difficult to counterfeit as it is made by opacifying the polymer substrate throughout the entire layer thickness or throughout the entire layer of a coating applied to the layer. The optical security feature of the security feature is also more durable and robust as the number of print layer overcoats are not reduced, and the opacified regions in the polymer cannot wear out and cannot be rubbed off. Finally, as mentioned, due to the scattering of light caused by the bubbles, the security feature is more covert and hidden to a viewer when viewed in reflected light; meaning its effectiveness as a security feature is enhanced.

Definitions

Security Document or Token

As used herein the term security document includes all types of documents and tokens of value and identification documents including, but not limited to the following: items of currency such as banknotes and coins, credit cards, cheques, passports, identity cards, securities and share certificates, driver's licenses, deeds of title, travel documents such as airline and train tickets, entrance cards and tickets, birth, death and marriage certificates, and academic transcripts.

The invention is particularly, but not exclusively, applicable to security documents such as banknotes or identification documents such as identity cards or passports formed from a substrate to which one or more layers of printing are applied. The security features described herein may also have application in other products, such as packaging.

Substrate

As used herein, the term substrate refers to the base material from which the security document or token is formed. The base material may be paper or other fibrous material such as cellulose; a plastic or polymeric material including but not limited to polypropylene (PP), polyethylene (PE), polycarbonate (PC), polyvinyl chloride (PVC), polyethylene terephthalate (PET); or a composite material of two or more materials, such as a laminate of paper and at least one plastic material, or of two or more polymeric materials.

The use of plastic or polymeric materials in the manufacture of security documents pioneered in Australia has been very successful because polymeric banknotes are more durable than their paper counterparts and can also incorporate new security features and features. One particularly successful security feature in polymeric banknotes produced for Australia and other countries has been a transparent area or "window".

Transparent Windows and Half Windows

As used herein the term window refers to a transparent or translucent area in the security document compared to the substantially opaque region to which printing is applied. The window may be fully transparent so that it allows the transmission of light substantially unaffected, or it may be partly transparent or translucent partially allowing the transmission of light but without allowing objects to be seen clearly through the window area.

A window area may be formed in a polymeric security document which has at least one layer of transparent polymeric material and one or more opacifying layers applied to at least one side of a transparent polymeric substrate, by omitting least one opacifying layer in the region forming the window area. If opacifying layers are applied to both sides of a transparent substrate a fully transparent window may be formed by omitting the opacifying layers on both sides of the transparent substrate in the window area.

A partly transparent or translucent area, hereinafter referred to as a "half-window," may be formed in a polymeric security document which has opacifying layers on both sides by omitting the opacifying layers on one side only of the security document in the window area so that the "half-window" is not fully transparent, but allows some light to pass through without allowing objects to be viewed clearly through the half-window.

Alternatively, it is possible for the substrates to be formed from an substantially opaque material, such as paper or fibrous material, with an insert of transparent plastics material inserted into a cut-out, or recess in the paper or fibrous substrate to form a transparent window or a translucent half-window area.

Opacifying Layers

One or more opacifying layers may be applied to a transparent substrate to increase the opacity of the security document. An opacifying layer is such that $LT<L0$ where $L0$ is the amount of light incident on the document, and LT is the amount of light transmitted through the document. An opacifying layer may comprise any one or more of a variety of opacifying coatings. For example, the opacifying coatings may comprise a pigment, such as titanium dioxide, dispersed within a binder or carrier of heat-activated cross-linkable polymeric material. Alternatively, a substrate of transparent plastic material could be sandwiched between opacifying layers of paper or other partially or substantially opaque material to which indicia may be subsequently printed or otherwise applied.

Security Device or Feature

As used herein the term security device or feature includes any one of a large number of security devices, elements or features intended to protect the security document or token from counterfeiting, copying, alteration or tampering. Security devices or features may be provided in or on the substrate of the security document or in or on one or more layers applied to the base substrate, and may take a wide variety of forms, such as security threads embedded in layers of the security document; security inks such as fluorescent, luminescent and phosphorescent inks, metallic inks, iridescent inks, photochromic, thermochromic, hydrochromic or piezochromic inks; printed and embossed features, including relief structures; interference layers; liquid crystal devices; lenses and lenticular structures; optically variable devices (OVDs) such as diffractive devices including diffraction gratings, holograms and diffractive optical elements (DOEs).

BRIEF DESCRIPTION OF DRAWINGS

Embodiments of the invention will now be described with reference to the accompanying drawings. It is to be understood that the embodiments are given by way of illustration only and the invention is not limited by this illustration. In the drawings.

DETAILED DESCRIPTION

Figure 1:
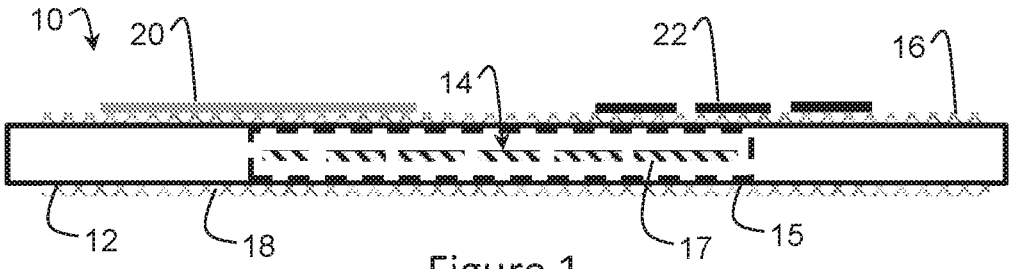
FIG. 1 is a sectional view of a security document according to an embodiment of the present invention.

Referring to FIG. 1, there is shown an embodiment of a security document 10 including a polymer substrate 12, a first print layer 16 disposed on one side of the polymer substrate 12, and a second print layer 18 disposed on the opposed side of the polymer substrate 12. In the embodiment, the polymer substrate 12 is a transparent substrate of the security document 10 made from a transparent polymer and the security document 10 is a polymer based bank note. The polymer substrate 12 will hereinafter be referred to as a transparent substrate 12 and the security document 10 will hereinafter be referred to as a polymer based bank note 10. In the embodiment, the first 16 and second 18 print layers are opacifying layers disposed on the transparent substrate 12. The first 16 and second 18 print layers will hereinafter be referred to as first opacifying layer 16 and second opacifying layer 18.

The bank note 10 shown in the Figures includes a security feature 14 including an image area 15 embodied within the transparent substrate 12 and at least partially covered by the first and second opacifying layers 16 18. It can be seen from the cross-sectional view in the embodiment shown in the Figures, the image area 15 is embodied wholly within the transparent substrate 12 and is completely covered by both the first and second opacifying layers 16 18 disposed on both sides of the transparent substrate 12.

Figure 2:
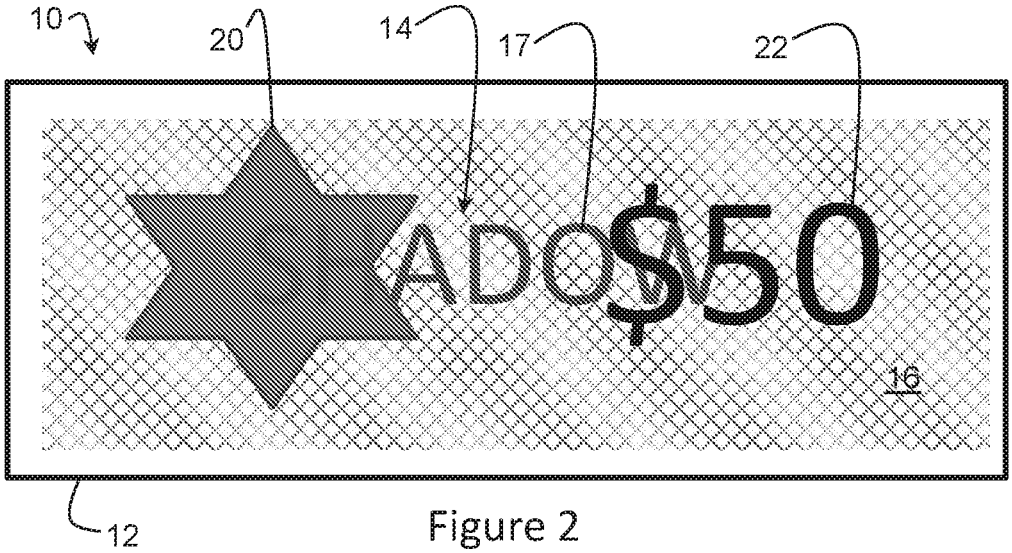
FIG. 2 is a top view of the security document of FIG. 1 showing a security feature viewed in transmission according to an embodiment of the present invention.
Figure 3:
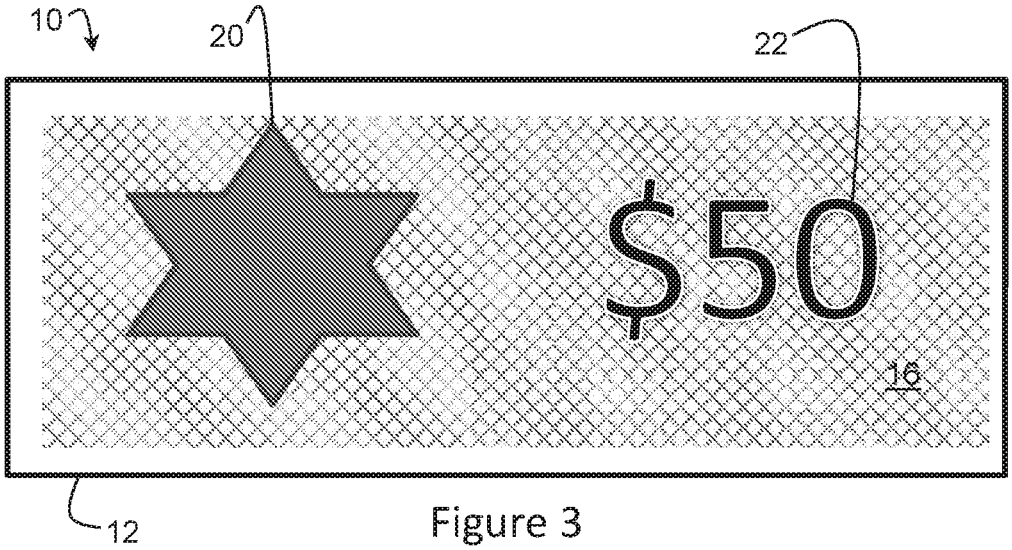
FIG. 3 is a top view of the security document of FIG. 1 viewed in reflection according to an embodiment of the present invention.

The security feature 14 in the Figures is an optical security feature 17 in the form of a shadow image formed in the image area 15 which is discernible when illuminated by light and when viewed in transmission of the light though the security feature 14. The optical security feature 17 will hereinafter be referred to as shadow image 17. The shadow image 17 is shown in FIG. 2 as the text "SHADOW", and FIG. 2 represents the bank note 10 being viewed in transmission. That is, the shadow image 17 can be discerned when the bank note 10 is placed between the viewer and the source of the light. In FIG. 3, on the other hand, the text "SHADOW" is not discernible as FIG. 3 represents the bank note 10 being illuminated and viewed in reflection of the light. As mentioned, the security feature 14 is thus covert and intended to be hidden to a viewer when viewed in reflected light to enhance its effectiveness as a security feature.

FIGS. 2 and 3 also show first and second image elements 20 22 applied to the bank note 10. It will be appreciated that these image elements 20 22 are normally found on bank notes, such as the first element 20 being a "star" and the second image element 22 being a denomination (e.g. "$50"). In the embodiment, these image elements 20 22 are formed in design layers applied to the first opacifying layer 16 These image elements are applied with an ink having a colour that is different from the colour of the first 16 or second opacifying layers 18 to provide visual design elements of the bank note 10. Additional image element layers could also be applied, on top of the first and second opacifying layers 16 18, using for example invisible inks, such as UV fluorescing or IR absorbing inks. Such images are machine readable images invisible to a viewer, but can be revealed using appropriate light sources and viewing equipment.

Figure 5:
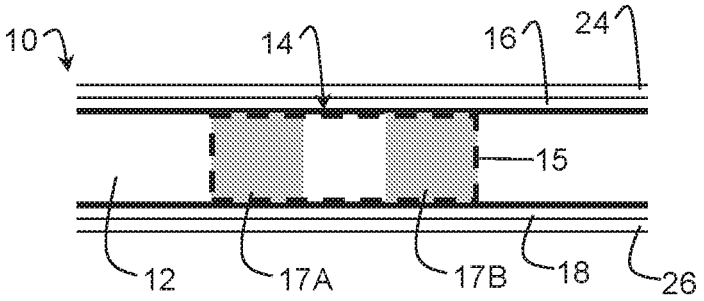
FIG. 5 is a further sectional view of a security document according to an embodiment of the present invention.

FIG. 5 shows an embodiment of a bank note 10 with multiple opacifying layers. The bank note 10 shown in FIG. 5 has the above mentioned security feature 14 in the image area 15 embodied within the transparent substrate 12. It can be seen from this Figure that the shadow image 17 includes first and second shadow image portions 17A 17B formed in the image area 15 that extend throughout the thickness of the transparent substrate 12. By opacifying the transparent substrate 12 throughout the entire thickness of the substrate, the shadow image 17 is more durable and is more difficult to counterfeit and to be rubbed off. Further, as the transparent substrate 12 is opacified throughout the entire thickness of the substrate, the shadow image 17 is more visible when viewed in transmission. In this embodiment also, the image area 15 of the bank note 10 is completely covered by two first opacifying layers 16 24 and two second opacifying layers 18 26.

As mentioned above, to form the shadow image 17, the transparent substrate 12, in one embodiment, is doped with particles that are configured to react to a designated wavelength of light from a light source to opacify the transparent substrate 12 adjacent these particles. That is, for example, a pigment, such as the above mentioned LS800 is embodied into the transparent substrate 12 which is doped with these particles. These particles react to the designated wavelength of light by absorbing energy from the designated wavelength and then by vaporising the transparent substrate 12 adjacent the particles to form bubbles in the transparent layer. Also, as mentioned, these bubbles scatter light to create a white appearance of the shadow image 17 if the shadow image 17 was viewed in direct reflection without being covered by the first 16 or second 18 opacifying layers. As the first 16 and second 18 opacifying layers, typically a white layer, at least partially cover the shadow image 17, the shadow image 17 is not readily discernible by the viewer when viewed in reflection of light from the security feature. Further, the scattered light also creates a dark appearance of the shadow image 17 when viewed in transmission of light that is discernible to the viewer. It will be appreciated by those persons skilled in the art that the light is white light from a light source such as the sun or electric lighting.

Figure 4:
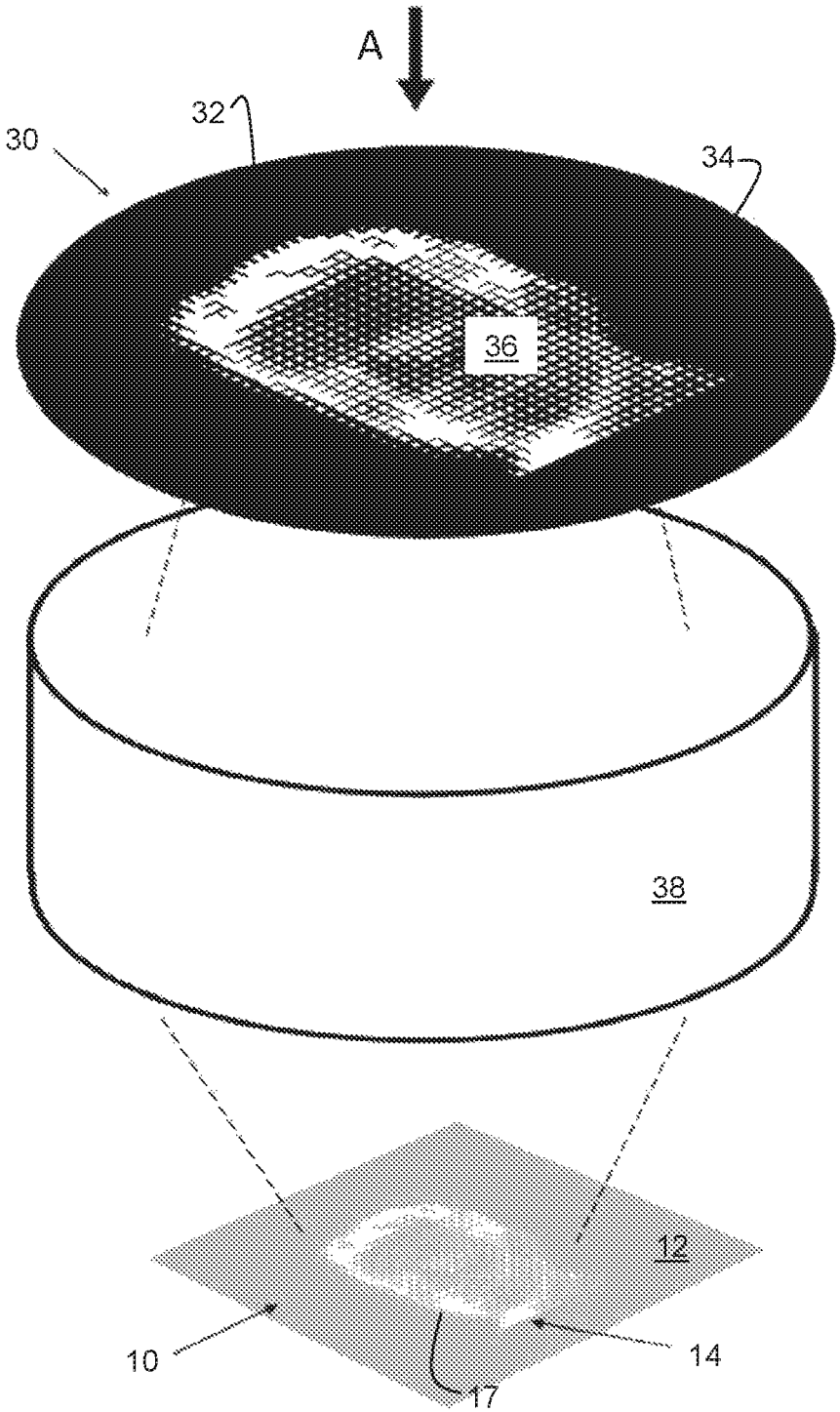
FIG. 4 is a schematic representation of part of an apparatus for use in manufacturing a security feature according to an embodiment of the present invention.

An embodiment of an apparatus 30 configured to manufacture a security feature 14 for a security document 10—in particular, a security feature for the above described bank note 10—is shown in FIG. 4. The apparatus 30 includes a laser (not shown) configured to irradiate the image area 15 in the transparent substrate 12 of the bank note 10 with a designated wavelength of light. In the example where the LS800 pigment is used, the light source is a CO2 laser having a designed wavelength of 9.4 μm or 10.6 μm. The laser beam is shown as arrow A and is first applied to an image mask 32 provided between the laser and the transparent substrate 12 of the bank note 10.

The image mask 32 shown in FIG. 4 includes an image area 36 corresponding to a desired shadow image that is formed from a first material. The first material is a material that is transmissive to the designated wavelength of light produced from the laser. The image mask 32 also includes a complementary area 34 to the image area 36 that is formed from a second material that is not transmissive to the designated wavelength of light. That is, the second material absorbs and dissipates the laser energy used for opacifying (e.g. marking) the transparent substrate 12 in the image area 15 but without itself being damaged. In an example, the first material is simply air and thus the image mask 32 is a negative of the image corresponding to a desired shadow image made of the second material. Here, the shadow image 17 formed on the transparent substrate 12 shown in FIG. 4 is an image of a person's head, and the image mask 32 is a negative of the image of the person's head formed out of the second material.

In another embodiment, the shadow image is made by directly writing an image on the transparent substrate 12 using a scanning laser system (not shown). It will be appreciated that this embodiment may be of particular interest when the security document is not a bank note, for example when the security document is an ID card. Turning back to the embodiment in FIG. 4, the image mask 32 enables the shadow image 17 to be formed quicker and it will be appreciated that speed is required for manufacturing bank notes.

The apparatus 30 for manufacturing the security feature 14 also includes a demagnification optic 38 to reduce the size of the shadow image 17 to be formed on the transparent substrate 12 to a desired size and to ensure the laser energy density in the image area is sufficiently high to form bubbles in the transparent substrate 12. In use of the apparatus 30, the laser irradiates the image area 15 embodied within the transparent substrate 12 via the image mask 32 and the demagnification optic 38. The transparent substrate 12 has particles disposed therein that react to the designated wavelength of light of the laser to opacify the transparent substrate 12 adjacent the particles to form the shadow image 17 in the form of the person's head in the image area 15.

To then complete the security feature 14, the bank note 10 is transported to another apparatus (not shown) for at least partially covering 46 of the image area 15 with at least one opacifying layer 16 18 on one or both sides of the transparent substrate 12. The shadow image 17 created directly in the image area 15 can thus be completely covered by the opacifying layers 16 18 applied on top on both sides, on one side (½ window), or a combination thereof. In any event, the security feature 14 is thus a shadow image 17 as above which is discernible when illuminated by light and when viewed in transmission. The size and density of the formed shadow image 17 is related to the thickness of the transparent substrate 12 containing the pigment, the amount of pigment contained within the transparent substrate 12 and the influence of the laser applied (energy per unit area).

For example, the transparent substrate 12 is optically clear polymer film manufactured by Innovia Films Wigton which is doped with finely dispersed particles having high absorbance to a specific laser irradiation wavelength. A single pulse of laser irradiation having the designated wavelength is directed through the image mask 32 and the demagnification optic 38—forming a mask projection optical system—onto the doped polymer film 12 effecting localised heating and bubble formation to thereby spatially opacify the film 12 in correspondence with regions 36 of the image mask 32 that are optically transmissive to the designated wavelength of laser radiation. The image 32 mask transmissive regions 36 are in correspondence with a desired spatial distribution of tonality in the shadow image 17 and the mask transmissive regions 36 are in correspondence with mask design rules defining the relationship between spatial distribution of opacity in the film 12 and spatial distribution of tonality in the shadow image 17.

Figure 6:
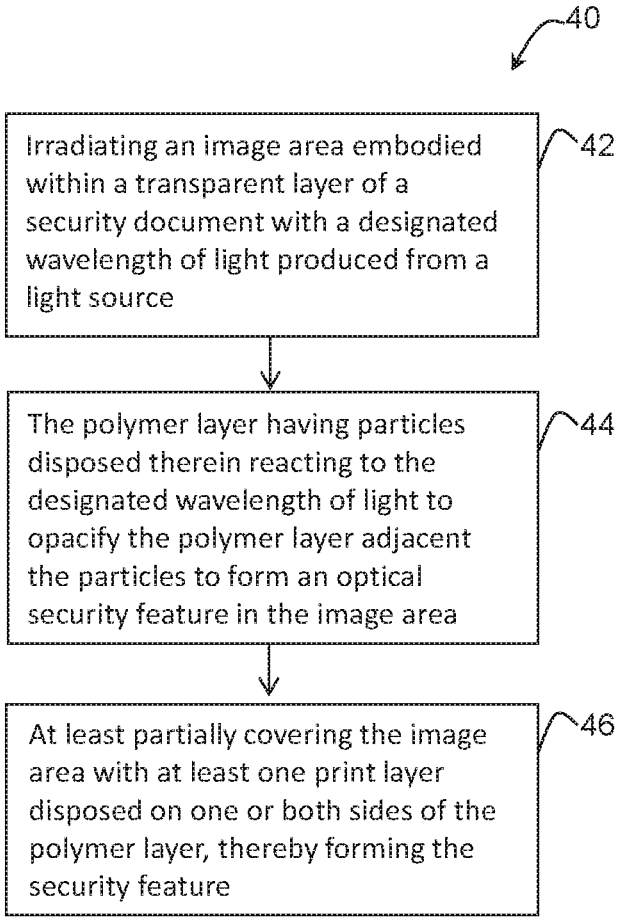
FIG. 6 is a flowchart showing a method of manufacturing a security feature for a security document according to an embodiment of the present invention.

Referring now to FIG. 6, there is shown a summary of a method 40 of manufacturing a security feature for a security document, the method including: irradiating 42 an image area embodied within a polymer substrate of a security document with a designated wavelength of light produced from a light source; the polymer substrate having particles disposed therein reacting 44 to the designated wavelength of light to mark or opacify the polymer substrate adjacent the particles to form an optical security feature in the image area; and at least partially covering 46 the image area with at least one print layer disposed on one or both sides of the polymer substrate, thereby forming the security feature as the optical security feature in the image area which is discernible when illuminated by light and when viewed in transmission of the light though the security feature.

Further aspects of the method 40 will be apparent from the above description of the bank note 10. A person skilled in the art will also appreciate that at least parts of the method 40 could be embodied in program code for implementation on a microprocessor of the apparatus 30. The program code could be supplied in a number of ways, such as on a memory of the apparatus 30 or in data communication with the microprocessor.

Figure 7A:
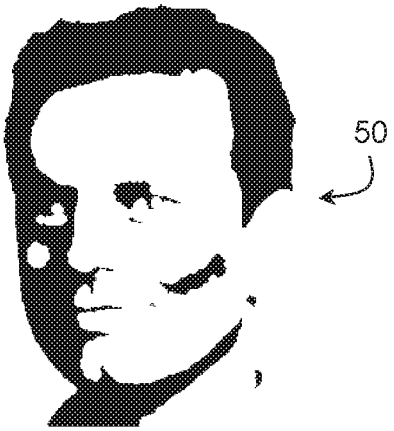
FIGS. 7A and 7B are representations of an optical security feature and a printed image according to another embodiment of the present invention.
Figure 7B:
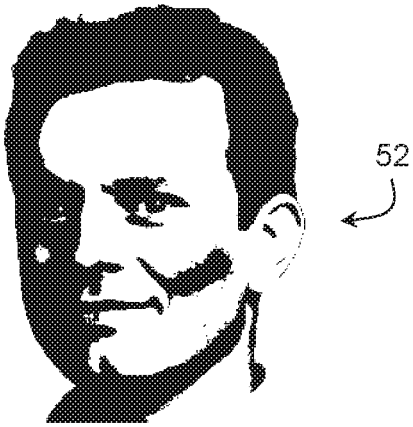

In another embodiment of the invention, with reference to FIGS. 7A and 7B, the security document is a polymer based bank note and the polymer substrate is an opaque substrate made from a white polymer. In this embodiment, the print layer includes a printed image wholly overlying the optical security feature.

FIG. 7A shows an optical security feature 50 derived from a corresponding printed image 52 (shown in FIG. 7B). The printed image 52 is a gravure banknote design element, in this example a portrait that is printed in a dark colour. The optical security feature 50 is designed such that it is smaller in extent than the printed image 52 by at least an amount taking into account a registration tolerance, such that the optical security feature 50 is completely covered by the printed image 52 in the final security document.

Similarly to the transparent substrate example, the polymer substrate in this embodiment has particles disposed therein configured to react to a designated wavelength of light by absorbing energy and vaporising the polymer substrate adjacent the particles to form markings in the polymer substrate. The markings in this case absorb light to create a dark appearance of the optical security feature when the optical security feature is viewed in direct reflection of light from the security feature. That is, the markings would create a dark appearance of the optical security feature if it was viewed directly without the print layer covering it. For example, the optical security feature may appear dark black or dark blue.

In this embodiment, the printed image 52 effectively camouflages the optical security feature 50 when viewed in direct reflection of light such that the optical security feature 50 is hidden from view. When the security document is viewed in transmitted light, the optical security feature may or may not be visible. There may be a contrast between the printed image 52 and security feature 50 due to transmitted light being absorbed by the markings of the optical security feature 50. However, it is possible that no shadow image is produced. In either case, the optical security feature 50 produces an indelible image in the substrate that survives after the printed image 52 has worn off.

Figure 8A:
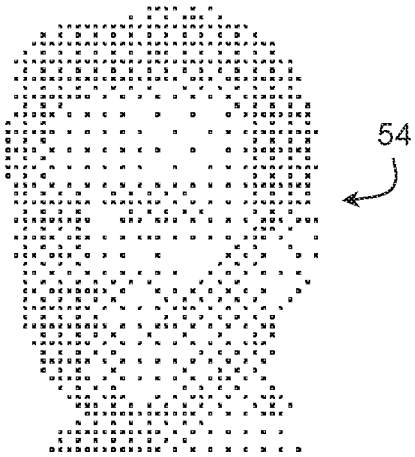
FIGS. 8A, 8B and 8C are representations of an optical security feature, a printed image and the optical security feature with overlaid printed image according to another embodiment of the present invention.
Figure 8B:
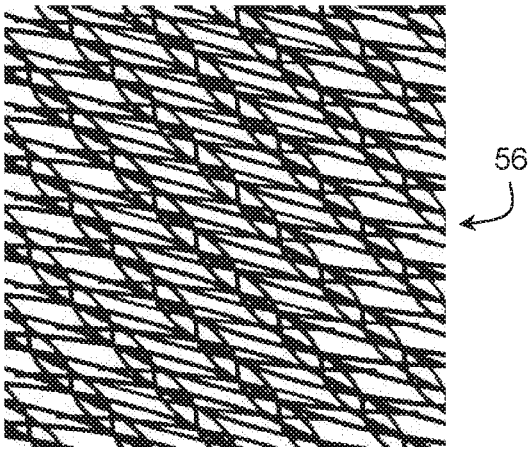
Figure 8C:
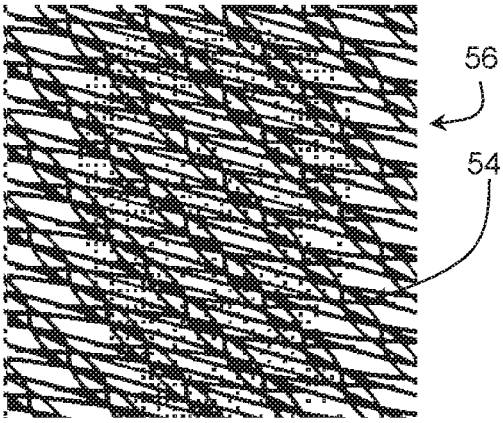

FIGS. 8A-8C illustrate another embodiment of the invention involving a white polymer substrate. In this embodiment, an optical security feature 54, shown in FIG. 8A, is a dithered binary image of a portrait and the printed image 56, shown in FIG. 8B, is a repeating pattern of straight and curved lines. In the final security document, the printed image 56 overlies part of the optical security feature 54 as shown in FIG. 8C.

In this embodiment, the optical security feature 54 differs from the printed image 56 such that the printed image does not wholly overlie the optical security feature. However, the printed image 56 effectively camouflages the optical security feature 54 when viewed in direct reflection of light, as the optical security feature 54 appears faint and difficult to discern. The optical security feature 54, however, is visible in transmitted light, as the markings of the optical security feature 54 absorb enough transmitted light to produce an image with adequate contrast when viewed in transmission. The end result could be considered as a type of shadow image.

It will be appreciated that the method and apparatus described above for manufacturing an optical security feature in a transparent substrate using a laser and laser marking additives or pigments may also be used to manufacture a security feature in an opaque substrate. The difference in the process between the two substrates being that in the transparent substrate the laser markings appear white, whereas in the opaque substrate the laser markings appear dark.

While the invention has been described in conjunction with a limited number of embodiments, it will be appreciated by those skilled in the art that many alternative, modifications and variations in light of the foregoing description are possible. Accordingly, the present invention is intended to embrace all such alternative, modifications and variations as may fall within the spirit and scope of the invention as disclosed.

Any reference herein to a patent document or other matter which is given as prior art is not to be taken as an admission that that document or matter was known or that the information it contains was part of the common general knowledge as at the priority date of any of the claims.

The present application may be used as a basis or priority in respect of one or more future applications and the claims of any such future application may be directed to any one feature or combination of features that are described in the present application. Any such future application may include one or more of the following claims, which are given by way of example and are non-limiting in regard to what may be claimed in any future application.

The invention claimed is:

1. A security document, including:

an opaque polymer substrate having particles disposed therein configured to react to a designated wavelength of light from a light source, wherein the polymer substrate is opaque before reacting to the designated wavelength of light;

at least one print layer, the print layer being substantially opaque when viewed in reflection, disposed on one or both sides of the opaque polymer substrate; and a security feature including an image area embodied within the opaque polymer substrate and at least partially covered by the at least one print layer, wherein the security feature is an optical security feature which includes markings formed from exposure of the particles to the designated wavelength of light in the image area, wherein the particles absorb energy and vaporize the polymer substrate adjacent the particles, wherein the markings absorb light to create a dark color and are discernible when illuminated by light and viewed in transmission of said light through the security feature.

2. A security document according to claim 1, wherein the image area is completely covered by the at least one print layer disposed on one or both sides of the polymer substrate.

3. A security document according to claim 2, wherein the at least one print layer includes a printed image overlying at least part of the optical security feature.

4. A security document according to claim 3, wherein the optical security feature is derived from the printed image such that the printed image wholly overlies the optical security feature.

5. A security document according to claim 3, wherein the optical security feature differs from the printed image such that the printed image does not wholly overlie the optical security feature.

6. A security document according to claim 1, wherein the particles react to the designated wavelength of light by absorbing energy from the designated wavelength of light and vaporising the polymer substrate adjacent the particles to form bubbles in the polymer substrate.

7. A security document according to claim 6, wherein the bubbles scatter light or the markings absorb light to create the dark color of the optical security feature when the optical security feature is viewed in transmission of the light through the security feature.

8. A security document according to claim 1, wherein the markings absorb light to create the dark color of the optical security feature when the optical security feature is viewed in direct reflection of the light from the optical security feature.

9. A method of manufacturing a security feature for a security document, the method including:

irradiating an image area embodied within an opaque polymer substrate of a security document with a designated wavelength of light produced from a light source;

the opaque polymer substrate having particles disposed therein reacting to the designated wavelength of light to form an optical security feature in the image area, wherein the optical security feature includes markings formed from exposure of the particles to the designated wavelength of light in the image area, wherein the particles absorb energy and vaporize the polymer substrate adjacent the particles; and at least partially covering the image area with at least one print layer, the print layer being substantially opaque when viewed in reflection and being disposed on one or both sides of the polymer substrate, wherein the markings absorb light to create a dark color, which is discernible when illuminated by light and viewed in transmission of said light.

10. A method according to claim 9, further including:

irradiating an image mask provided between the light source and the polymer substrate of the security document with the designated wavelength of light produced from the light source, wherein the image mask includes an image area corresponding to the optical security feature formed from a first material and a complementary area to the image area formed from a second material.

11. A method according to claim 10, wherein the first material is transmissive to the designated wavelength of light produced from the light source and the second material is not transmissive to the designated wavelength of light.

* * * * *